United States Patent [19]

Otsuka et al.

[11] Patent Number: 4,804,168

[45] Date of Patent: Feb. 14, 1989

[54] APPARATUS FOR TREATING MOLTEN METAL

[75] Inventors: Ryotatsu Otsuka; Shigemi Tanimoto; Kazuo Toyoda, all of Sakai, Japan

[73] Assignee: Showa Aluminum Corporation, Osaka, Japan

[21] Appl. No.: 21,887

[22] Filed: Mar. 4, 1987

[30] Foreign Application Priority Data

Mar. 5, 1986 [JP] Japan ..... 61-49146

[51] Int. Cl.[4] ..... C21C 7/072

[52] U.S. Cl. ..... 266/235; 75/59.3; 75/67 R; 261/87

[58] Field of Search ..... 266/142, 143, 226, 218, 266/235, 266; 75/68 R, 59.3; 261/87

[56] References Cited

U.S. PATENT DOCUMENTS 277,831 5/1883 Burridge ..... 266/143

FOREIGN PATENT DOCUMENTS 208432 10/1985 Japan ..... 266/226

1062279 12/1983 U.S.S.R. ..... 266/235

*Primary Examiner*—Melvyn J. Andrews

*Assistant Examiner*—Robert L. McDowell

*Attorney, Agent, or Firm*—Armstrong, Nikaido Marmelstein & Kubovcik

[57] ABSTRACT

An apparatus for treating a molten metal comprises a vertical post, a treating container disposed at one side of the post and having an opening at its upper end for containing the molten metal, a horizontal suspending arm mounted at its base end on the post upwardly and downwardly movably and rotatable in a horizontal plane, a vertical rotary shaft suspended from the arm and having a treating gas channel internally extending therethrough longitudinally, a bubble releasing-dispersing rotor provided at the lower end of the rotary shaft and having in its bottom surface a treating gas outlet in communication with the gas channel, the rotor being movable into and out of the container through the opening, and at least one baffle suspended from the arm and movable into and out of the container through the opening for preventing eddying and waving. When there arises a need to repair or relace the rotary shaft, the rotor and/or the baffle, or when the dross is to be removed from the surface of molten metal after the treatment, the rotor, the shaft and the baffle are brought out of the container by raising the suspending arm and are thereafter brought to a position away from immediately above the container by horizontally moving the arm. The above work is then performed.

9 Claims, 3 Drawing Sheets

APPARATUS FOR TREATING MOLTEN METAL

BACKGROUND OF THE INVENTION

The present invention relates to an apparatus for treating a molten metal such as aluminum or magnesium in a molten state, and more particularly to an apparatus for use in treating a molten metal in a treating container by releasing a treating gas into the molten metal in the form of finely divided bubbles and dispersing the bubbles through the entire body of molten metal to remove hydrogen and other dissolved harmful elements and non-metallic inclusions from the molten metal.

The terms "aluminum" and "magnesium" as used herein include pure aluminum and aluminum alloys, and pure magnesium and magnesium alloys, respectively. Further the term "inert gas" as used herein refers to argon gas, helium gas, krypton gas and xenon gas in the Periodic Table and also to other gases which are inert to the metal to be melted, such as ntirogen gas which is inert to aluminum.

Apparatus of the type mentioned heretofore used for treating molten metal comprise a treating container having an opening at the upper end and a closure for openably closing the opening, a vertical rotary shaft extending through the closure into the treating container and having a treating gas channel internally extending through the shaft longitudinally thereof, and a bubble releasing-dispersing rotor attached to the lower end of the rotary shaft and having in its bottom a treating gas outlet in communication with the gas channel of the rotary shaft (see U.S. Pat. No. 4,611,790). The rotary shaft is rotated while supplying a treating gas, such as an inert gas or chlorine gas, to the gas channel of the shaft to release the gas into molten metal within the container in the form of finely divided bubbles and disperse the bubbles through the entire body of molten metal for the treatment of the molten metal.

It appears possible to improve the efficiency of treatment by the conventional apparatus described by finely dividing the injected gas and dispersing the gas through the interior of the container more effectively. The rotor must be rotated at a higher speed to divide the gas more finley and disperse the bubbles uniformly throughout the container. However, if the speed of rotation of the rotor is increased in the conventional apparatus, the surface of the molten metal markedly eddies and waves, consequently promoting formation of an oxide by the contact of the metal with the atmosphere and penetration of hydrogen into the molten metal (e.g. $2Al+3H_2O \rightarrow Al_2O_3+6H$). The eddy aslo incorporates the dross on the surface of the melt into the body of molten metal. Moreover, the vigorous eddy collects bubbles of gas in the center of the eddy, i.e. in the vicinity of the rotary shaft for the rotor, no longer permitting the dispersion of gas bubbles through the entire treating container. Consequently, the treatment efficiency rather lowers.

Accordingly, an apparatus has been proposed which is of the same type as above and in which a baffle for preventing eddying and waving is suspended from the closure covering the open upper end of the container so as to be immersed in the molten metal within the container (see Utility Model Publication No. Sho 60-161162). Nevertheless, when the vertical rotary shaft of the baffle is to be repaired or replaced, there arises a need to upwardly withdraw the shaft from the container and to remove the closure. The proposed apparatus thus requires a cumbersome procedure.

Further when the dross floating on the surface of the molten metal within the container is to be removed after the completion of treatment, the rotary shaft and the baffle become obstacles to this procedure, so that the shaft and the cover must be withdrawn or removed, hence cumbersomeness.

SUMMARY OF THE INVENTION

An object of the present invention is to provide an apparatus which is so adapted that the vertical rotary shaft and the baffle for preventing eddying and waving can be repaired or replaced with ease.

Another object of the present invention is to provide an apparatus which assures facilitated removal of dross after the treatment.

The present invention provides an apparatus for treating a molten metal which comprises a treating container having an opening at its upper end for containing the molten metal, suspending means disposed above the treating container and movable upward and downward and futher in a horizontal plane, a vertical rotary shaft suspended from the suspending means and having a treating gas channel internally extending therethrough longitudinally, the rotary shaft being movable into and out of the treating container through the opening, a bubble releasing-dispersing rotor provided at the lower end of the rotary shaft and having in its bottom surface a treating gas outlet in communication with the gas channel of the rotary shaft, the rotor being movable into and out of the container through the opening, and at least one baffle suspended from the suspending means and movable into and out of the container through the opening for preventing eddying and waving.

Before the repair or replacement of the rotary shaft and/or the baffle, the rotary shaft and the baffle are moved together upward out of the treating container by raising the suspending means, and the shaft and the baffle are then shifted from a position immediately above the container by moving the suspending means horizontally. The rotary shaft and the baffle are moved in the same manner as above before the dross is removed from the surface of molten metal after the treatment. Accordingly, the contemplated work can be carried out easily.

Since the rotary shaft and the bubble can be moved out of the container together by raising the suspending means, these members can be brought out of the container with ease. The shaft and the baffle are therefore movable into and out of the container even frequently without cumbersomeness, with the result that the shaft and the baffle can be immersed in molten metal only during the treatment for removing hydrogen and non-metallic inclusions from the molten metal. This diminishes consumption of these members. Moreover, the above work can be conducted while the molten metal is placed in the container or in a hot environment.

The present invention will be described in greater detail with reference to the accompanying drawings.

DESCRIPTION OF THE PREFERRED EMBODIMENTS

Figure 1:
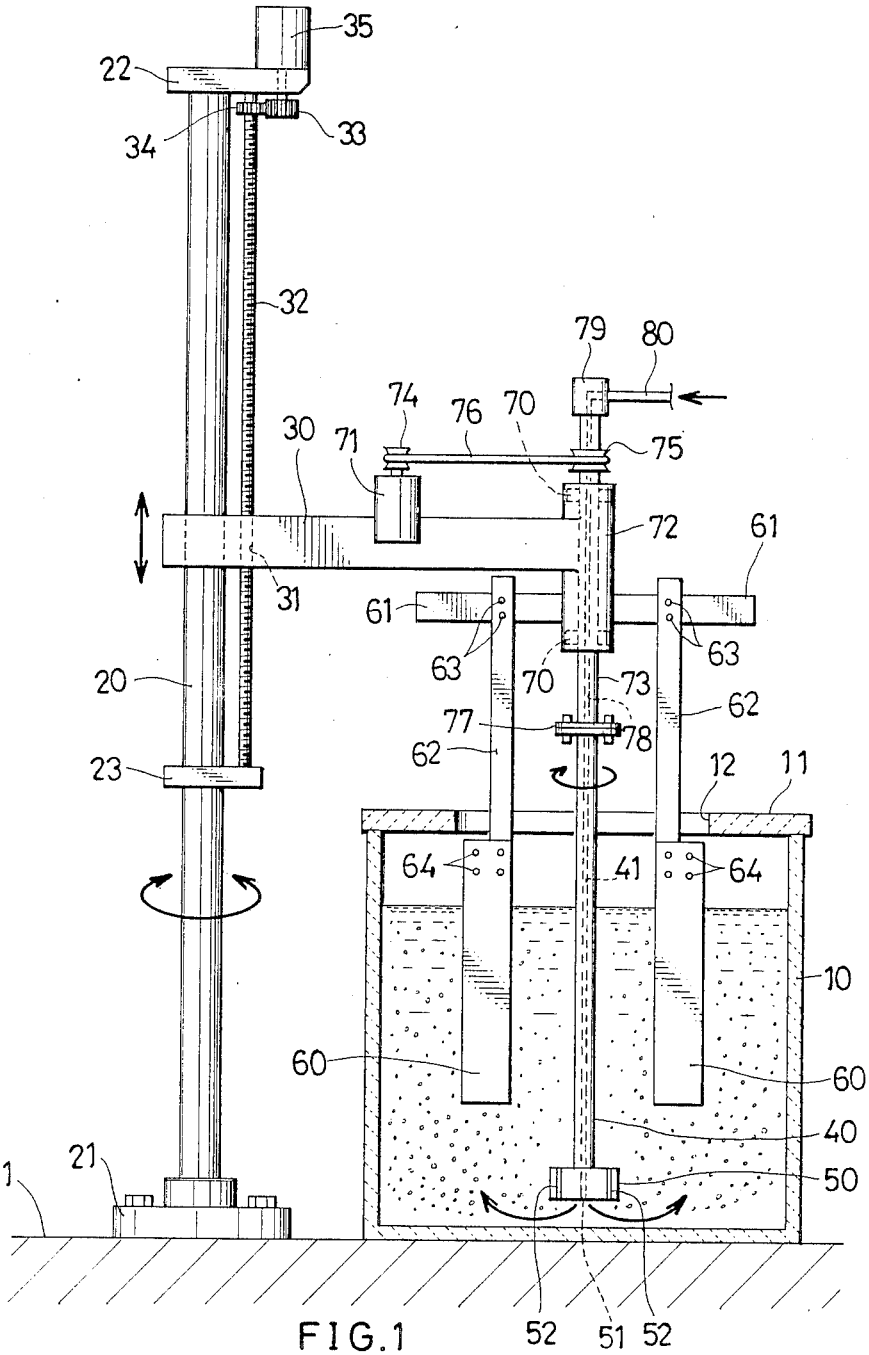
FIG. 1 is a front view of an apparatus embodying the invention, with a treating container shown in section.

Throughout the drawings, like parts are designated by like reference numerals.

With reference to FIG. 1 showing an embodiment of the invention, the molten metal treating apparatus comprises a treating container 10 installed on a floor 1 for containing the molten metal to be treated, a suspender support post 20 disposed outside the container 10 and extending upright from the floor,1, suspending means such as a horizontal arm 30 disposed above the treating container 10, mounted on the post 20 upwardly and downwardly movably and movable horizontally, a gas injecting vertical rotary shaft 40 suspended from the arm 30 and having a treating gas channel 41 longitudinally extending through the shaft in its interior, a bubble releasingdispersing rotor 50 provided at the lower end of the rotary shaft 40 and having in its bottom surface a treating gas outlet 51 in communication with the gas channel 41, and two baffles 60 suspended from the arm 30 and movable toward or away from the vertical rotary shaft 40 for preventing eddying and waving.

The treating container 10 has at its upper end an opening which is closed with a removable closure 11. The closure 11 has an opening 12 through which the shaft 40 and the baffles 60 are brought into and out of the container 10.

The post 20 is mounted on a base 21 fixed to the floor 1 on which the container 10 is placed. The post 20 is rotatable about its own axis and can be fixed at a desired position around the axis. The post 20 has at least two times the height of the container 10. The post 20 has brackets 22 and 23 at its upper end and at a level lower than the midportion of its height, respectively.

The arm 30 is slidably fitted, at its one end, around the post 20 between the two brackets 22 and 23. The post 20 is provided with a mechanism for moving the arm 30 upwardly and downward along the post 20. This mechanism comprises a vertical screw rod 32 rotatably supported by the brackets 22, 23, extending vertically through the arm 30 and screwed in an internally threaded bore 31 formed in the arm 30, and a motor 35 mounted on the upper bracket 22 for rotating the screw rod 32 by means of gears 33, 34. The motor 35, when driven, rotates the screw rod 32 through the gears 33, 34 and raises or lowers the arm 30. When the arm 30 is raised, the rotor 50 and the baffles 60 are brought out of the container 10. The arm 30 is rotatable with the post 20 about the axis of the post 20.

The arm 30 is provided with a mechanism for drivingly rotating the vertical rotary shaft 40. This mechanism comprises a motor 71 mounted on the arm 30, a vertical tube 72 attached to the forward end of the arm 30, a drive shaft 73 extending through the vertical tube 72 and rotatably supported by bearings 70 on the tube 72 while being prevented from moving vertically, a pulley 74 mounted on the output shaft of the motor 71, a pulley 75 mounted on the drive shaft 73 and a belt 76 reeved around the pulley 74, 75. The vertical rotary shaft 40 is fixedly connected to the lower end of the drive shaft 73 by a flange joint 77. The motor 71 rotates the rotary shaft 40 through the pulleys 74, 75, the belt 76 and the drive shaft 73. The drive shaft 73 is internally formed with a treating gas channel 78 in communication with the gas channel 41 of the rotary shaft 40. A gas supply pipe 80 extending from an unillustrated treating gas supply source is connected to the upper end of the drive shaft 73 by a rotary seal 79. The gas supply source supplies a treating gas comprising an inert gas, a mixture of inert gas and chlorine gas or the like.

The bubble releasing-dispersing rotor 50 is formed in its bottom surface with a plurality of grooves (not shown) extending radially from the gas outlet 51 to the outer periphery of the rotor. The peripheral surface of the rotor 50 is formed with a plurality of vertical grooves 52 each positioned between the open outer ends of two adjacent radial grooves.

The baffle 60 for preventing eddying and waving is in the form of a vertically elongated rectangle. Two arms 61 extend laterally from the vertical tube 72 in opposite directions and each has a suspender 62 suspended therefrom and laterally slidable. The baffle 60 is suspended from the lower end of the suspender 62. The suspender 62 is fixed in a desired position to the arm 61 with screws 63. The baffle 60 is removably fastened to the suspender 62 with screws 64. The lower end of the baffle 60 is positioned slightly above the rotor 50. While the number and dimensions of baffles 60 may be determined by experiments in accordance with the inside diameter of the treating container 10, the depth of the molten metal to be placed in the container 10, the diameter of the rotor 50, etc., the proper conditions can be determined generally from the following equation.

$$\log W = \log D + 1/1.2 \log (0.35/N)$$

wherein

W: width of the baffle,

D: inside diameter of the treating container, and

N: number of baffles.

When a plurality of baffles 60 are used, it is desirable to arrange the baffles at a spacing around the rotary shaft 40.

The treating container 10, rotary shaft 40, rotor 50 and baffles 60 are made of a refractory material, such as graphite or silicon carbide, which is not active on molten metals.

When a molten metal is to be treated by the above apparatus, the molten metal is first placed into the treating container 10 with the arm 30 in a raised position. Further before the treatment, the arm 30 is rotated by rotating the post 20 to position the rotary shaft 40 and the baffle plate 60 immediately above the opening 12, and the distance between the baffles 70 and the rotary shaft 40 is so adjusted that the baffles can be brought into the container 10 through the opening 12. Next, the screw rod 32 is rotated by the motor 35 through the gears 33, 34 to lower the arm 30 along the post 20 and the screw rod 32, whereby the rotary shaft 40 and the baffles 60 are placed into the container 10 through the opening 12 and immersed in the molten metal.

In this state, a treating gas is supplied to the rotor 50 from the supply source (not shown) via the supply pipe 80, the gas channel 78 of the drive shaft 73 and the gas channel 41 of the rotary shaft 40, while the drive shaft 73 is rotated by the motor 71. The gas is released from the outlet 51 in the bottom surface of the rotor 50 via the lower end opening of the gas channel 41 of the rotary shaft 40. The centrifugal force resulting from the rotation of the rotor 50 and the action of the radial bottom grooves and the vertical grooves 52 divide the gas into fine bubbles, which are dispersed throughout the entire container 10. The gas removes hydrogen and nonmetallic inclusions from the molten metal.

The hydrogen in the molten metal diffuses through the interior of the gas bubbles, is entrained in the gas bubbles when the bubbles pass upward through the molten metal and is released from the surface of the melt to the atmosphere. The nonmetallic inclusions in the molten metal are carried by the gas bubbles to the dross layer on the melt surface. The hydrogen-containing treating gas released into the atmosphere, as well as the dross containing the nonmetallic inclusions and floating on the melt surface, is removed by a suitable knowm method. While the baffles 60 act to prevent the molten metal from eddying and the molten metal surface from waving when the rotary shaft 40 is rotated with the rotor 50, the baffles further promote agitation of the molten metal, consequently permitting the hydrogen in the melt to diffuse through the gas bubbles effectively to achieve an improved hydrogen removal efficiency. Additionally, the baffles act to promote upward migration of nonmetallic inclusions through the melt.

When the operation is interrupted after the removal of hydrogen and nonmetallic inclusion from the molten metal, or when the rotary shaft 40 or the baffle 60 is to be replaced or repaired, the screw rod 32 is rotated by the motor 35 to raise the arm 30 and bring the rotary shaft 40 and the baffles 60 out of the container 10, and the post 20 is rotated to shift these members to a position away from immediately above the container 10. At this position, the part is replaced or repaired. Further when the dross is to be removed from the melt surface after the treatment for removing hydrogen and nonmetallic inclusions, or when maintenance or inspection work is to be conducted inside the container, the arm 10 is first raised to withdraw the shaft and the baffles from the container 10, and the arm 30 is thereafter rotated with the post 20 to move these parts away from immediately above the container 10. The rotary shaft 40 and the baffles 60 then will not become obstacles in removing the dross or in carrying out maintenance or inspection work inside the container 10. This assures improved work efficiency and enhanced safety.

Next, an operation example of the apparatus shown in FIG. 1 will be described.

Figure 2:
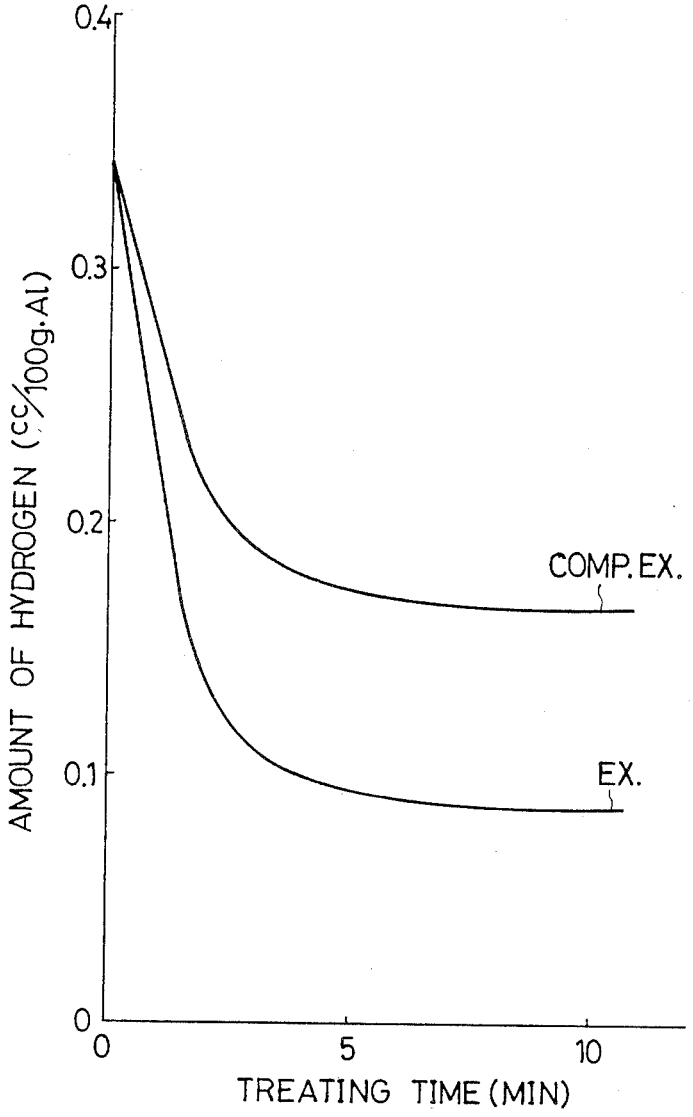
FIG. 2 is a graph showing the relation between the treating time and the amount of hydrogen in molten metal, as established by operating the apparatus of FIG. 1 and by a comparative example.

Into the container 10 was placed 500 kg of A6063 alloy in a molten state, which was maintained at 700° to 730° C. by heating. While rotating the rotor at 1,000 r.p.m., a treating gas, namely Ar gas, was fed to the container at a rate of 20 liters/min. The amount of hydrogen in the melt was measured by the TELEGAS method at a predetermined time interval after the start of treatment. FIG. 2 shows the result. The molten metal was also checked for the removal of nonmetallic inclusion at a specified time interval after the start of treatment. For this purpose, a portion of the molten metal sampled was cast into a piece using a copper mold with a cavity of 40 mm in depth and 100 mm in diameter, and the cast piece was faced on a lathe to prepare a surface, which was then subjected to anodic oxidation treatment and coloring treatment. The number of inclusion defects (not smaller than 0.1 mm in size) in the surface was counted using a magnifying glass. The result is listed in the table below. For comparison, FIG. 2 and the table also show the results achieved by an apparatus which was not equipped with any baffle.

| Number of Inclusion Defects in Cast Piece (per $dm^2$) | | | |
|---|---|---|---|
| | Treating time | | |
| Treating system | 0 min (Before treatment) | 3 min | 6 min |
| Example of invention | At least 100 | 1 | 0 |
| Comparative example | At least 100 | 23 | 21 |

FIG. 2 and the above table reveal that the treatment by the apparatus of the invention superior to the treatment by the apparatus having no baffle in hydrogen removal efficiency and inclusion removal efficiency.

Figure 3:
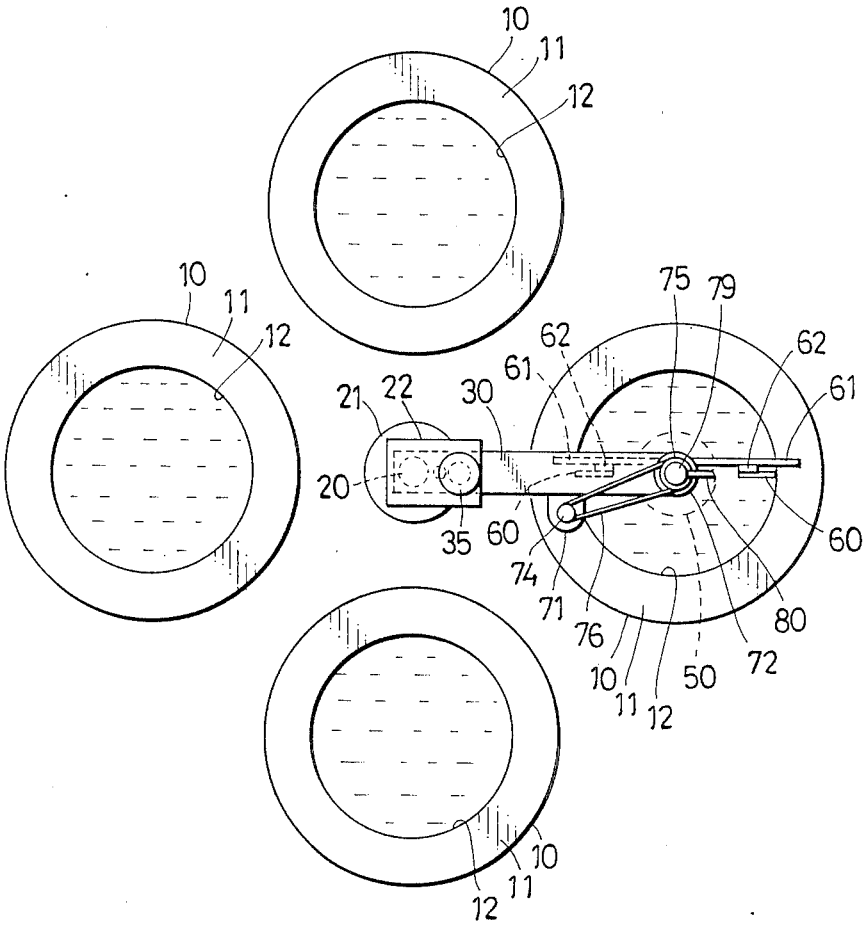
FIG. 3 is a plan view showing another apparatus embodying the invention.

FIG. 3 shows another apparatus embodying the present invention. The molten metal placed in a plurality of treating containers is treated by the apparatus shown for the removal of hydrogen and nonmetallic inclusions successively from container to container. This embodiment differs from the first one in that the plurality of treating containers 10 are arranged on a floor 1 around the post 20. With this apparatus, when the molten metal in one container 10 has been treated, the rotary shaft 40 and the baffles 60 are moved to immediately above another container 10 adjacent to the first container by raising the arm 30 and rotating the post 20. The arm 30 is then lowered to treat the molten metal in the second container. In this way, the molten metal in the containers 10 is treated successively from container to container.

The molten metal placed in a plurality of treating containers 10 can be treated successively also by an apparatus which comprises, although not shown, a rail installed on the floor, a post 20 movable straight along the rail, and an arm 30 movable horizontally straight. The plurality of treating containers 10 are arranged in a straight row in parallel with the rail on the floor. When the molten metal in one container has been treated in this arrangement, the rotary shaft 40 and the baffles 60 are moved to immediately above the next container 10 by raising the arm and rotating the post, and the arm 30 is then lowered to treat the molten metal in the second container. In this way, the molten metal in the containers is treated successively.

Although the suspending means is an arm mounted on the upright post on the floor according to the embodiments described, such suspending means is not limitative. For example, means suspended from the ceiling of a building in which the apparatus is installed may serve as the suspending means.

While the present invention has been described above as applied to a batchwise treating apparatus wherein the molten metal to be treated is placed into the treating container, then treated therein and thereafter sent to another process, the invention may be embodied as an in-line treating apparatus wherein the treating container is disposed on a flow channel for molten metal to treat the molten metal while the melt is being continuously passed through the container.

The present invention may be embodied further differently without departing from the spirit and basic features of the invention. Accordingly, the embodiments herein disclosed are given for illustrative purposes only and are in no way limitative. It is to be understood that the scope of the invention is defined by the appended claims rather than by the specification and that all alterations and modifications within the definition and scope of the claims are included in the claims.

What is claimed is:

1. An apparatus for treating a molten metal by releasing a treating gas into the molten metal in the form of finely divided bubbles and dispersing the bubbles throughout the entire body of molten metal to remove dissolved harmful elements and nonmetallic inclusions from the molten metal, the apparatus comprising:

a treating container having an opening at its upper end for containing the molten metal, suspending means disposed above the treating container and movable upward and downward and in a horizontal plane, a vertical tube provided for the suspending means, a vertical rotary shaft inserted through the vertical tube and having a treating gas channel internally extending therethrough longitudinally, a bubble releasing-dispersing rotor provided at the lower end of the rotary shaft and having in its bottom surface a treating gas outlet in communication with the gas channel of the rotary shaft, the rotary being movable into and out of the container through the opening, a horizontal suspending bar fixed to the vertical tube, at least one baffle for preventing eddying and waving suspended from the suspending bar, movable toward and away from the vertical rotary shaft along the suspending bar, and also movable into and out of the treating container through the opening, and a fixing means for adjustably and removably fixing said baffle to the suspending bar.

2. An apparatus as defined in claim 1 which further includes a vertical post at one side of the treating container, the suspending means being mounted on the post.

3. An apparatus as defined in claim 2 wherein the suspending means is a horizontal arm mounted at its based end on the post, and the arm is upwardly and downwardly movable along the post and rotatable about the axis of the post.

4. An apparatus as defined in claim 1 wherein the rotary shaft being connected to the lower end of the drive shaft.

5. An apparatus as defined in claim 4 wherein the drive shaft has a treating gas channel internally extending therethrough longitudinally, and the gas channel has a lower end communicating with the gas channel of the rotary shaft and an upper end communicating with a treating gas supply pipe via a rotary joint.

6. An apparatus for treating a molten metal by releasing a treating gas into the molten metal in the form of finely divided bubbles and dispersing the bubbles throughout the entire body of molten metal to remove dissolved harmful elements and nonmetallic inclusions from the molten metal, the apparatus comprising:

a vertical post rotatable about its own axis, a treating container disposed at one side of the post and having an opening at its upper end for containing the molten metal, a horizontal suspending arm mounted at its base end on the post upwardly and downwardly movable and rotatable with the post, means for moving the suspending arm upward and downward along the post, a vertical tube attached to the forward end of the suspending arm, a drive shaft inserted through the vertical tube and having a treating gas channel internally extending therethrough longitudinally, a vertical rotary shaft connected to the lower end of the drive shaft and having a treating gas channel internally extending therethrough longitudinally in communication with the gas channel of the drive shaft, a treating gas supply pipe connected to the upper end of the drive shaft by a rotary joint, means for driving the drive shaft, a bubble releasing-dispersing rotor provided at the lower end of the rotary shaft and having in its bottom surface a treating gas outlet in communication with the gas channel of the rotary shaft, the rotor being movable into and out of the container through the opening, a horizontal suspending bar fixed to the vertical tube, at least one baffle suspended from the suspending bar and movable along the suspending bar toward or away from the vertical tube for preventing eddying and waving, the baffle being movable into and out of the container through the opening, and a fixing means for adjustably fixing said baffle to the suspending bar.

7. An apparatus as defined in claim 6 wherein the means for moving the suspending arm comprises two brackets attached to the post, a screw rod extending between and rotatably supported by the brackets and extending through the suspending arm in screw-thread engagement therewith, a gear fixed to the upper end of the screw shaft, a motor mounted on the upper bracket, and a gear fixed to the output shaft of the motor and meshing with the gear on the screw shaft.

8. An apparatus as defined in claim 6 wherein the means for driving the drive shaft comprises a motor mounted on the suspending arm, a pulley fixed to the output shaft of the motor, a pulley fixed to the drive shaft and a belt reeved around the two pulleys.

9. An apparatus for treating a molten metal by releasing a treating gas into the molten metal in the form of a finely divided bubbles and dispersing the bubbles throughout the entire body of molten metal to remove dissolved harmful elements and nonmetallic inclusions from the molten metal, the apparatus comprisng:

a vertical post, a plurality of treating containers arranged around the post for placing the molten metal therein, each of the containers having an opening at its upper end, suspending means mounted on the post, the suspending means being movable upward and downward along the post and rotatable about the axis of the post, a vertical tube provided for the suspending means, a vertical rotary shaft inserted through the vertical tube and having a treating gas channel internally extending therethrough longitudinally, a bubble releasing-dispersing rotor provided at the lower end of the rotary shaft and having in its bottom surface a treating gas outlet in communication with the gas channel of the rotary shaft, the rotor being movable into and out of each of the containers through the opening, a horizontal suspending bar fixed to the vertical tube, at least one baffle suspended from the suspending bar and movable along the suspending bar and into and out of each of the containers through the opening for preventing eddying and waving, and a fixing means for adjustably fixing said baffle to the suspending bar.

* * * * *